United States Patent [19]

Coone

[11] Patent Number: 4,772,158

[45] Date of Patent: Sep. 20, 1988

[54] METHOD AND APPARATUS FOR SETTING INFLATABLE PACKERS IN DEEP WATER

[75] Inventor: Malcolm G. Coone, Katy, Tex.

[73] Assignee: Max Bassett, Houston, Tex.

[21] Appl. No.: 830,460

[22] Filed: Feb. 18, 1986

[51] Int. Cl.[4] ..... E02D 5/00

[52] U.S. Cl. ..... 405/227; 405/224; 405/195; 277/28; 277/34

[58] Field of Search ..... 405/11, 12, 195, 199, 405/223, 224, 225, 227; 277/28, 30, 34, 34.3, 34.6; 166/187, 387; 137/81.2; 251/1.2, 1.3; 114/331, 333, 335

[56] References Cited

U.S. PATENT DOCUMENTS

| | | | |
|---|---|---|---|
| 3,228,369 | 1/1966 | Warhurst et al. | 114/331 |
| 3,527,296 | 9/1970 | Malone | 277/34 X |
| 3,647,245 | 3/1972 | Hanes et al. | 405/195 X |
| 4,063,427 | 12/1977 | Hoffman | 405/225 |
| 4,140,426 | 2/1979 | Knox | 405/225 |
| 4,184,790 | 1/1980 | Bassett | 405/225 |
| 4,275,974 | 6/1981 | Knox et al. | 405/225 |
| 4,294,284 | 10/1981 | Herd | 137/81.2 X |
| 4,337,010 | 6/1982 | Sullaway et al. | 405/227 |
| 4,372,704 | 2/1983 | Knox | 405/225 |
| 4,449,584 | 5/1984 | Christensen | 166/387 |

FOREIGN PATENT DOCUMENTS

| | | | |
|---|---|---|---|
| 1424527 | 2/1976 | United Kingdom | 114/331 |

*Primary Examiner*—Dennis L. Taylor
*Attorney, Agent, or Firm*—Vaden, Eickenroht, Thompson & Boulware

[57] ABSTRACT

A system is disclosed for setting inflatable packers underwater. The packers are used to seal the annulus between an anchor pile driven into the sea bed through a leg of the platform or through a skirt sleeve attached to a leg adjacent the sea bed to allow grout to be pumped into the annulus to connect the pile to the leg or skirt sleeve. The packer is inflated by fluid displaced from a pressure chamber located adjacent the packer by fluid under pressure located adjacent the packer, such as the ambient water.

15 Claims, 3 Drawing Sheets

FIG. 4
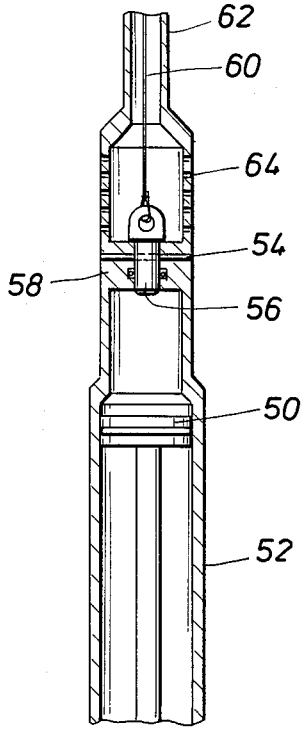
FIG. 5
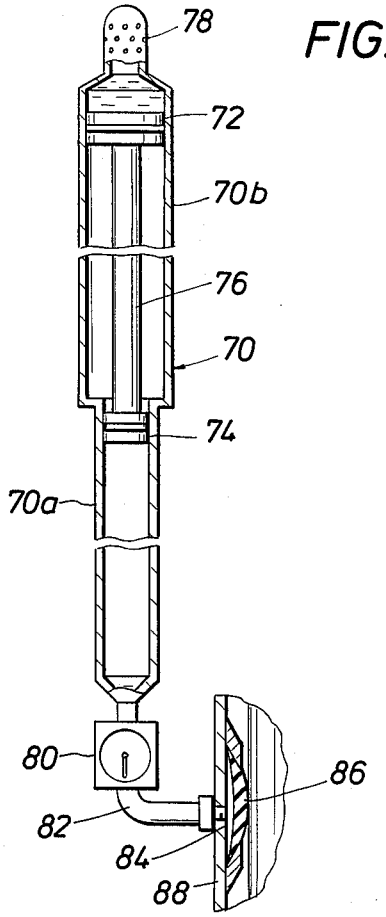
FIG. 6
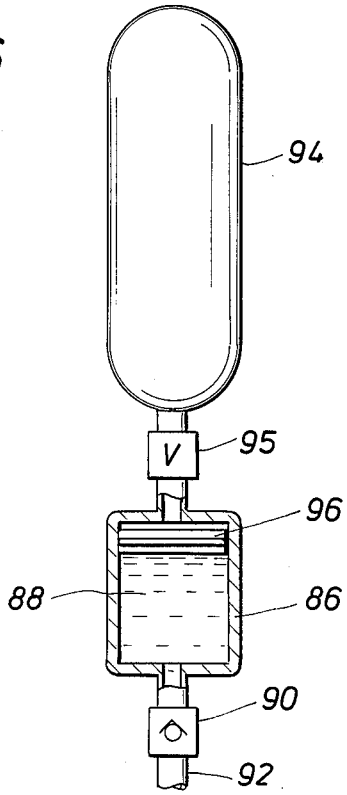
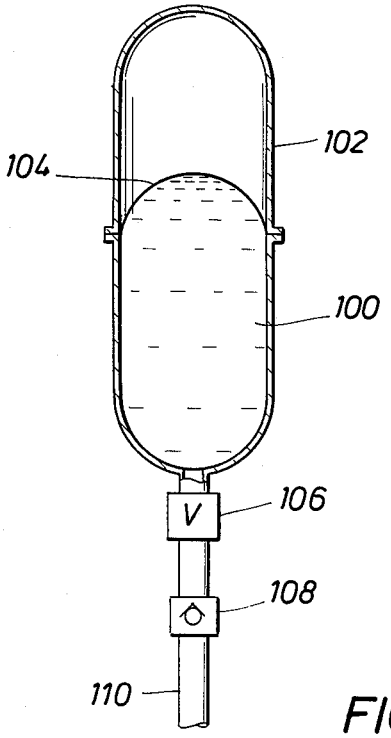
FIG. 7

METHOD AND APPARATUS FOR SETTING INFLATABLE PACKERS IN DEEP WATER

This invention relates to a system for inflating packers located underwater on a platform leg, skirt sleeve, other support member, or template of an offshore platform.

Offshore platforms that are supported by legs that extend to the sea floor have to be securely anchored to the sea floor. This is commonly done by driving piles into the sea floor through the support legs or through skirt sleeves attached to the support legs or other support members and filling the annulus between the piles and the support members with grout that, when it sets up, provides a secure connection between the pile and the support leg or skirt sleeve. To seal the annulus between the pile and the support leg or skirt sleeves, inflatable packers are used. Where the pile is driven through a support leg that extends from the bottom to the surface of the water, one packer is located adjacent the sea bed and, once inflated, grout is circulated above the packer to the surface or other predetermined height to provide a good solid connection between the pile and the support leg.

Where a skirt sleeve is used, one packer is located at the lower end of the sleeve and the other is usually, located at the upper end of the sleeve. In some cases, only the lower packer is used, but two packers are required if the annular space is to be evacuated with air before the grout is pumped in.

Drilling templates and templates for tension leg platforms are also anchored to the sea bed by piles driven into the sea bed. Here the piles are inserted into holes previously drilled through locking heads on the template. The locking heads attach the template to the piles after which the annulus between each pile and the drilled hole is filled with grout. Inflatable packers are located below the locking heads to keep the grout from reaching the locking heads.

The usual procedure for inflating the packers is to have a separate inflation line extending from the surface to each packer. A system has been proposed for reducing the number of such lines, this system is described in U.S. Pat. No. 4,140,426, which issued on Feb. 20, 1979. Even with that system, however, there will be a large number of separate lines extending from the surface to inflate the packers. As offshore drilling moves further and further away from the coast into deeper water, these lines get longer and longer. Since great care must be given to avoid breaking these lines, they complicate the construction of the platform, the moving of the platform to the location, and the installing of the platform on location. An example of how long these lines are getting is the size of the platform presently being built for Shell Oil Company that is 1,454 feet high (441 meters).

In addition, the pile driving hammers produce vibrations in the entire underwater structure that can break inflation lines and, once such a line is broken or springs a leak at a joint, the packer cannot be inflated, which means the cementing operation must proceed without a grout seal. A very undesirable situation.

Therefore, it is an object of this invention to provide a system for setting inflatable packers underwater that does not require an inflation line that extends from the packer to the surface.

It ss a further object of this invention to provide a system of setting inflatable packers that employs a source of fluid pressure adjacent the packer to inflate the packer.

It is a further object of this invention to provide such a system in which the hydrostatic head of the water at the location of the packer is used to provide the fluid pressure required to set the packer.

It is another object of this invention to provide a visual indication, observable by a diver or underwater camera, that the packer is set.

These and other objects, advantages, and features of this invention will be apparent to those skilled in the art from a consideration of this specification, including the attached drawings and appended claims.

In the Drawings

FIGS. 4–8 are alternate embodiments of apparatus to inflate a packer underwater.

Figure 1:
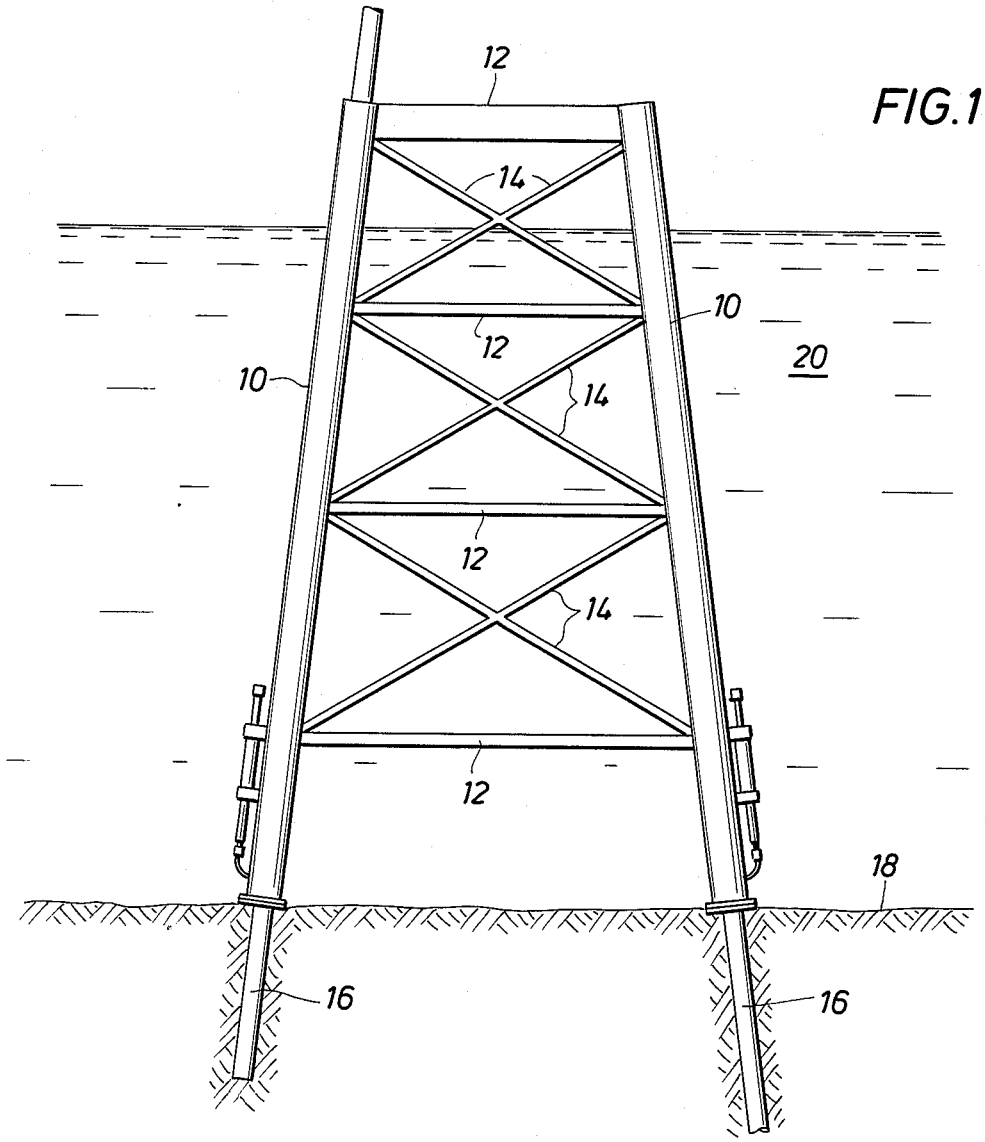
FIG. 1 is a view in elevation of a platform designed to be supported by the sea bed.

The invention will be described in connection with grout seals for a bottom supported platform. The structure of the platform shown in FIG. 1 is typical. It consists of hollow legs 10, only two of which are shown in the drawing but there are two more behind these and there may be substantially more. The legs are tied together by horizontal cross beams 12 and diagonal bracing 14. The platform shown is designed to have piles 16 driven through the legs into sea bed 18 below the body of water 20.

As explained above, some platforms attach skirt sleeves to the legs or other support members and the piles are driven through these sleeves into the sea bed. The skirt sleeves are usually substantially smaller in diameter than the legs and therefore several skirt sleeves can be arranged around the outside of each leg or attached to other support members remote from the leg.

In FIG. 1, the pile on the right-hand side has been driven to depth and the pile on the left-hand side is being driven to depth. As explained above, driving these piles into the sea bed creates tremendous vibrations in the underwater structure. This is particularly true of piles driven through skirt sleeves or other support members using underwater hammers. This vibration can break the inflation lines that extend from the packers to the surface a distance that may be well over a thousand feet. In the system of this invention, such lines are eliminated.

As explained above, in some cases there will be an upper and lower packer particularly if a skirt sleeve is used, but, as explained above, where the pile is driven from the surface through the support leg, only the lower packer is used and this is what is shown in the drawings. The system will be described in connection with the inflating of this packer, although the same system would be used to inflate an upper packer.

Figure 2:
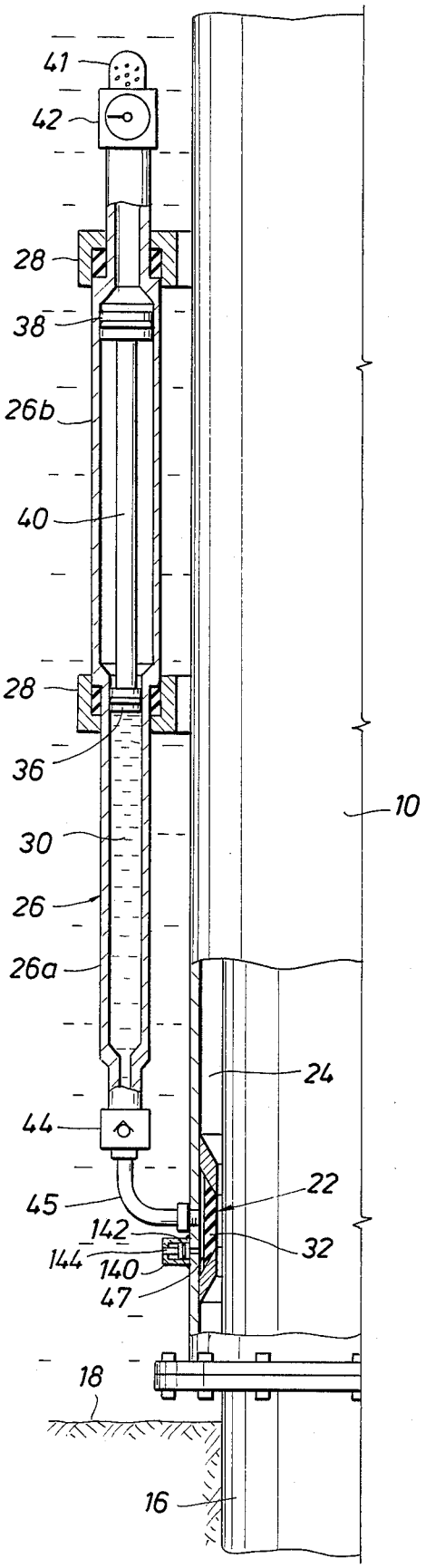
FIGS. 2 and 3 are cross-sectional views of the apparatus used in this system to inflate a packer.
Figure 3:
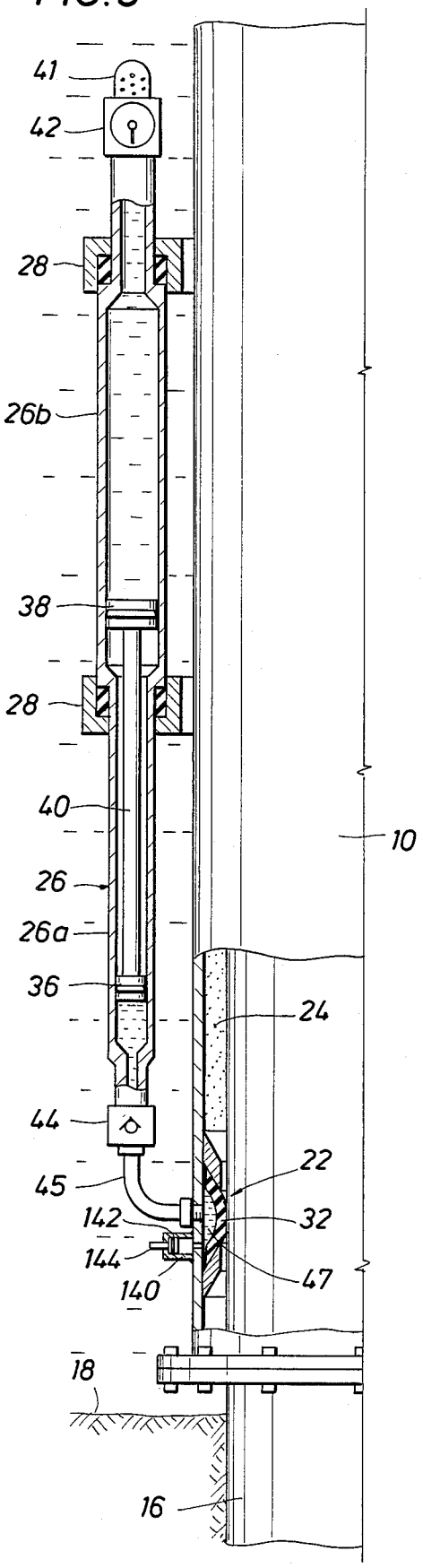

As shown in FIGS. 2 and 3, inflatable packer 22 is located inside the lower end of leg 10 just above sea bed 18. After pile 16 has been driven through leg 10 and packer 22 into the sea bed to the desired depth, it is connected to leg 10 by filling annulus 24 between the pile and the leg with grout.

In accordance with this invention, a pressure chamber containing fluid for inflating the packer is mounted on the platform adjacent the packer and connected to the packer. The fluid in the chamber is caused to flow from the chamber to the packer when it is desired to set the packer.

In the embodiment shown in FIGS. 2 and 3, pressure chamber 26 is attached to leg 10 adjacent packer 22 by mounting brackets 28. Lower section 26a of the chamber, check valve 44, conduit 45, and annular space 47 between the wall of leg 10 and packing element 32 are filled with fluid 30, preferably a liquid, for inflating the packer.

Means are provided that is responsive to fluid pressure to force setting fluid 30 out of chamber 26 into annular space 47 to force the packing element into sealing engagement with pile 16. In the embodiment shown, such means include upper cylindrical section 26b of chamber 26 that is larger in diameter than lower section 26a. First piston 36 is located in the upper end of section 26a and rests on top of inflating fluid 30. Second piston 38 is located at the upper end of section 26b and is supported by and connected to piston 36 by piston rod 40. Preferably, the space between the pistons is at atmospheric pressure.

The upper end of section 26b of the chamber is closed by remotely operated valve 42 to maintain the chamber at atmospheric pressure even though it is several hundred feet below the surface of the water.

When it is desired to inflate packer 22, an ultrasonic, acoustic, or RF signal is sent from the surface to open valve 42, the power for doing this being supplied by a battery in the conventional manner. When valve 42 opens, ambient water will flow into the upper end of chamber 26 and exert the hydrostatic pressure of the ambient water against piston 38. Piston 38 is larger in diameter than piston 36 to increase the pressure in inflating fluid 30. The pistons should be sized for the pressure of the inflating fluid to be high enough to overcome the hydrostatic pressure of the water around packing element 32 and the resistance of the packing element to being forced inwardly against the pile, plus enough pressure to hold the packing in sealing engagement with pile 16, as shown in FIG. 3, against the hydrostatic pressure of the grout in annulus 24. Check valve 44 will insure that the packer remains in sealing engagement with the pile once it has been set by the inflating fluid even though some leakage occurs around the pistons later. Strainer 41 keeps debris from entering the chamber.

With the packer set, annulus 24 can be filled with grout in the well-known manner and pile 16 will be securely connected to leg 10 and, combined with the piles grouted to the other legs, anchor the platform to the sea bed.

FIG. 4 shows an alternate arrangement for exposing second piston 50 located in the upper end of chamber 52 to the pressure of the ambient water. In this embodiment, hydrostatic pressure is prevented from acting against piston 50 by plug 54 located in opening 56 of partition 58. Wireline 60 is connected to plug 54 and extends to the surface through protective conduit 62. When it is desired to inflate the packer, an upward pull on flexible line 60 will remove plug 54 from opening 56 and allow ambient water to flow through strainer 64 into the upper end of chamber 52 and exert ambient hydrostatic pressure against piston 50 and inflate the packer in the manner described above in connection with FIGS. 2 and 3. This embodiment requires a conduit to extend to the surface if the control is to be at the surface, but is still a better system than the hydraulic lines previously used since a leak in this line will not affect the removal of plug 54 and the setting of the packer. Alternatively, the apparatus could be actuated by a diver lifting on line 62.

The embodiment shown in FIG. 5, is structurally substantially the same as the embodiment shown in FIGS. 2 and 3. Pressure chamber 70 includes lower section 70a of a diameter less than upper section 70b. Differential pistons 72 and 74 are connected by piston rod 76 and are positioned with lower piston 74 at the upper end of section 70a of the chamber and larger diameter piston 72 located at the upper end of chamber 70b. In this embodiment, upper piston 72 is exposed to the hydrostatic pressure of the ambient water at all times through strainer 78 at the top of the chamber. It is prevented from moving downwardly to force the fluid in lower section 70a of the chamber out of the chamber to set the packer by valve 80 located in conduit 82 that connects the lower end of the chamber to annular space 84 between packing element 86 and outer wall 88 of the leg of the platform.

In this embodiment, the fluid used to inflate the packer can be either air or liquid. If it is liquid, it would operate in the same manner as described in connection with the embodiment in FIGS. 2 and 3. The differential pistons would increase the pressure of the liquid sufficiently to inflate the packer and the liquid would be under this pressure at all times since differential piston 72 is exposed to hydrostatic pressure at all times. If air is used, the air in the lower chamber should be at about that required to inflate the packer before the chamber and the leg to which it is attached is lowered into the water. A suitable stop (not shown) will be required to make sure that the pressure of the air does not move lower piston 74 out of the upper end of the lower chamber before the hydrostatic pressure increases sufficiently to prevent such movement.

Valve 80 is the same type as valve 42 and can be opened remotely by RF, acoustic, or ultrasonic signals from the surface. When valve 80 is opened, the air flows from the chamber into the packer. The hydrostatic pressure of the ambient water acting on differential piston 72 will maintain the pressure of the air below piston 74 high enough to make sure that the packer is inflated. A check valve (not shown) can be located in conduit 82 so that the initial pressure acting on packing element 86 will be maintained even though there may be some leaks upstream from the check valve.

In the embodiment shown in FIG. 6, pressure chamber 86 is filled with inflating fluid 88 and connected to the packer through check valve 90 and conduit 92. Chamber 94 is filled with compressed gas at a sufficient pressure to cause piston 96 to displace the inflating fluid from chamber 86 and inflate the packer. Valve 95 is remotely actuated from the surface in the same manner as valve 42 in the embodiment shown in FIG. 2 and 3.

In FIG. 7, inflating fluid 100 is in the lower portion of pressure chamber 102 and separated from pressurized fluid located in the upper portion of chamber 102 by diaphragm 104. When valve 106 is opened, the pressure in the upper portion of chamber 102 will force inflating fluid 100 through check valve 108 and conduit 110 with sufficient pressure to inflate the packer.

Figure 8:
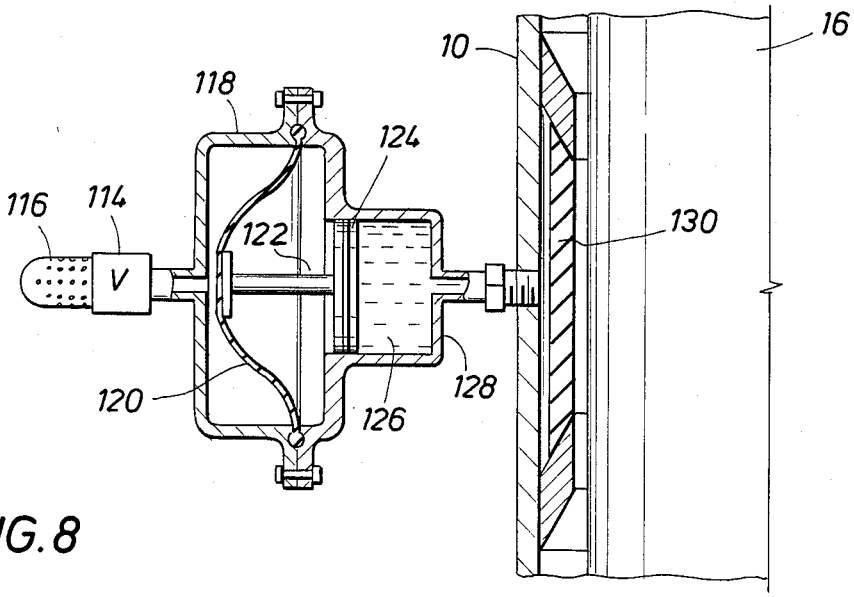

In FIG. 8, when remote operated valve 114 is opened, ambient water can flow through strainer 116 into pressure chamber 118 and act against diaphragm 120. The diaphragm, in turn, through rod 122 moves piston 124 to the right, as viewed in the drawing, displacing inflating fluid 126 in chamber 128 under sufficient pressure to set packer 130 and seal the annulus between pile 16 and leg 10.

Means are also provided to give a visual indication when fluid under pressure is acting against the packing element. In the embodiment shown in FIGS. 2 and 3, such means includes cylinder 140 in which is located piston 142. The pressure acting on the packing element also acts on the piston urging it to the left as viewed in the drawing. Ambient hydrostatic pressure urges it to the right. By manually moving the piston to the right by pushing on pin 144 connected to the piston, it will stay in this position until inflating fluid is supplied to the packer. This pressure will move the piston to the left and pin 144 will protrude from the end of the cylinder giving a visual indication that fluid under a pressure greater than ambient has reached the packer.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A method of setting an inflatable packer that is located underwater on a platform leg, skirt sleeve, or other support member comprising the steps of mounting a chamber containing sufficient fluid for inflating the packer underwater on the support member adjacent the packer, connecting the chamber to the packer and causing the fluid to flow from the chamber to the packer when it is desired to set the packer.

2. A method of setting an inflatable packer that is located underwater on a platform leg, skirt sleeve, or other support member of an offshore platform comprising the steps of mounting a pressure chamber containing fluid for inflating the packer on the platform adjacent the packer and connected thereto and connecting the pressure chamber to a source of fluid under hydrostatic pressure located underwater adjacent the packer to allow the fluid under pressure to displace sufficient fluid from the pressure chamber to set the packer.

3. A method of setting an inflatable packer that is located underwater on a platform leg, skirt sleeve, or other support member of an offshore platform comprising the steps of mounting underwater on a support member a pressure chamber containing fluid for inflating the packer and differential piston means movable in the chamber for displacing the fluid from the chamber to inflate the packer and opening a subsurface valve to allow the hydrostatic pressure of the water at the depth of the chamber to act on the differential piston means and increase the pressure of the fluid in the chamber sufficiently to set the packer.

4. Apparatus for setting an inflatable packer that is located underwater on a platform leg, skirt sleeve, or other support member of an offshore platform comprising a pressure chamber mounted on the platform adjacent the packer and containing sufficient fluid to set the packer, means responsive to fluid pressure to force the fluid out of the pressure chamber and set the packer, and valve means tc allow fluid pressure to act on said fluid responsive means and set the packer.

5. The apparatus of claim 4 in which the valve means is located between the chamber and the packer.

6. The apparatus of claim 4 in which the fluid pressure allowed to act on the fluid pressure responsive means is the hydrostatic pressure of the ambient water.

7. The apparatus of claim 4 in which the fluid pressure responsive means includes differential pistons to increase the pressure of the fluid in the chamber sufficiently to set the packer.

8. The apparatus of claim 4 further provided with means providing a visual indication when inflating fluid is acting on the packer.

9. The apparatus of claim 7 in which one of the pistons is a diaphragm.

10. Apparatus for inflating an underwater inflatable packer used as a grout seal in a platform leg, skirt sleeve, or other support member of an offshore platform comprising a chamber containing sufficient fluid to inflate the packer conduit, means connecting the chamber to the packer through which the fluid can flow to inflate the packer, differential piston means for displacing the fluid from the chamber, and valve means for allowing the ambient water pressure to cause the piston means to displace the fluid and inflate the packer.

11. The apparatus of claim 10 in which the valve means is remotely operated.

12. The apparatus of claims 10 or 11 in which the valve means is located in the connecting means between the chamber and the packer.

13. The apparatus of claims 10 or 11 in which the valve means is located in the connecting means between the chamber and the packer and the inflating fluid in the chamber is air at a pressure that is about the pressure required to set the packer.

14. The apparatus of claim 10 further provided with means providing a visual indication when inflating fluid is acting on the packer.

15. The apparatus of claim 10 in which the piston means includes a diaphragm.

* * * * *